United States Patent [19]

Baber et al.

[11] Patent Number: 5,007,646

[45] Date of Patent: Apr. 16, 1991

[54] GOLF PUTTING PRACTICE DEVICE

[76] Inventors: James A. Baber, 6447 Via Arboles, Anaheim, Calif. 92807; Joseph J. Cibere, 1541 Calle Artigas, Thousand Oaks, Calif. 91360

[21] Appl. No.: 560,782

[22] Filed: Jul. 31, 1990

[51] Int. Cl.[5] ..... A63B 69/36

[52] U.S. Cl. ..... 273/183 E; 273/192

[58] Field of Search ..... 273/192, 191 R, 191 A, 273/191 B, 183 R, 183 A, 183 E, 186 B, 186 C

[56] References Cited

U.S. PATENT DOCUMENTS

| | | | |
|---|---|---|---|
| 2,754,125 | 7/1956 | Engler | 273/192 |
| 2,776,836 | 1/1957 | Zadina | 273/192 |
| 3,246,898 | 4/1966 | Shoaf, Jr. | 273/186 R |
| 3,332,688 | 7/1967 | Gevertz | 273/192 |
| 3,375,010 | 3/1968 | Panza | 273/186 R |
| 3,656,752 | 4/1972 | Moriarty | 273/183 E |
| 3,853,325 | 12/1974 | Easterbrook | 273/183 E |
| 3,857,570 | 12/1974 | Gutierrez et al. | 273/186 C |
| 3,934,874 | 1/1976 | Henderson | 273/192 X |
| 3,953,033 | 4/1976 | Kelly et al. | 273/183 E |
| 4,053,160 | 10/1977 | Salata | 273/186 A |
| 4,116,447 | 9/1978 | Becker | 273/183 B |
| 4,736,952 | 4/1988 | Taft et al. | 273/183 E |

*Primary Examiner*—George J. Marlo
*Attorney, Agent, or Firm*—Jones, Tullar & Cooper

[57] ABSTRACT

A golf putting practice device includes an elongated base that has a generally vertical planar putter guide surface. A sight is positionable in one of a plurality of grooves located above this guide surface. The sight extends out and above the guide surface in a generally cantilever manner and includes a sight loop which is useable to allow a golfer to ascertain whether or not he has held his head steady during a putting stroke.

10 Claims, 2 Drawing Sheets

FIG. 1
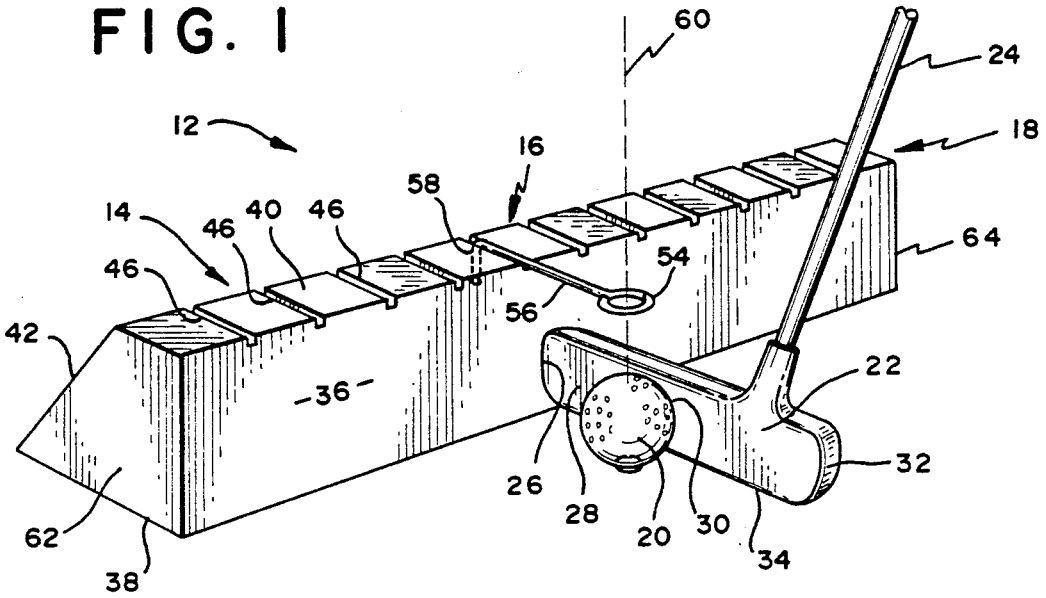
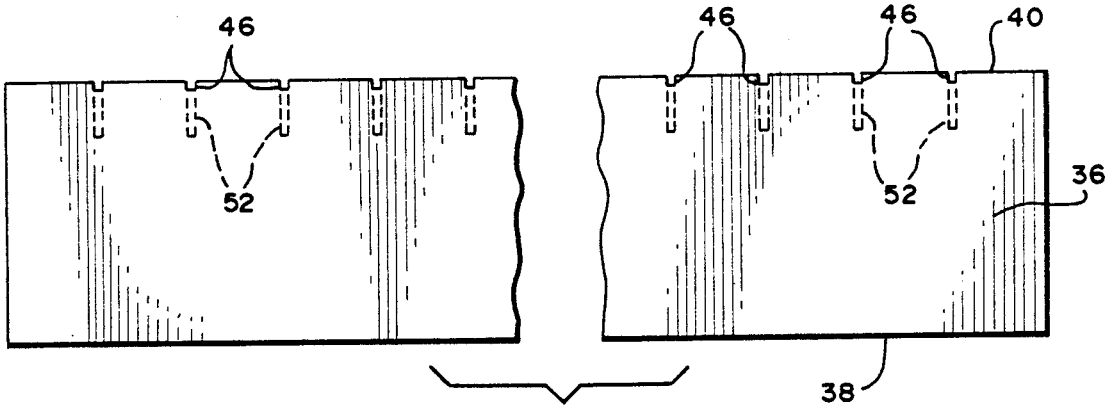
FIG. 2
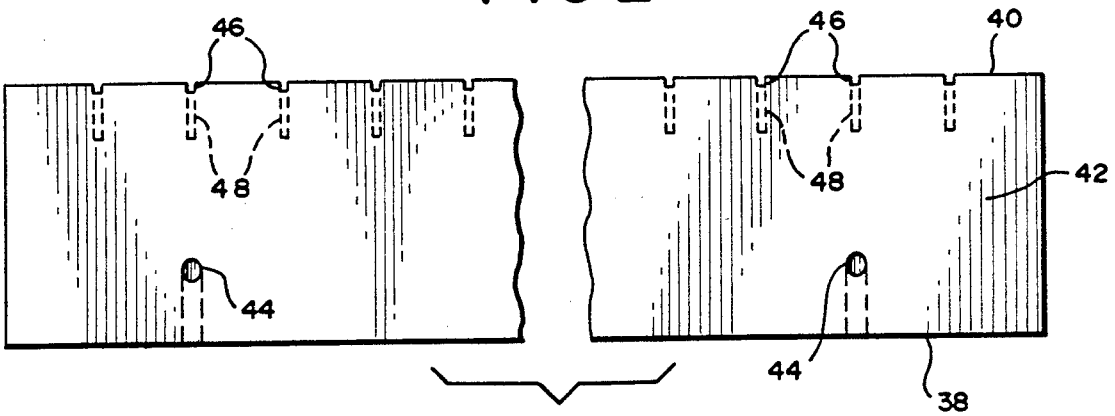
FIG. 3

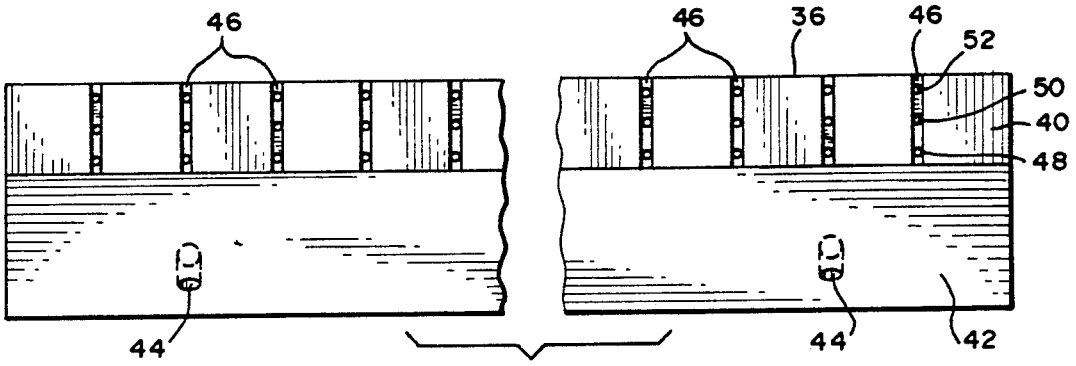
FIG. 4
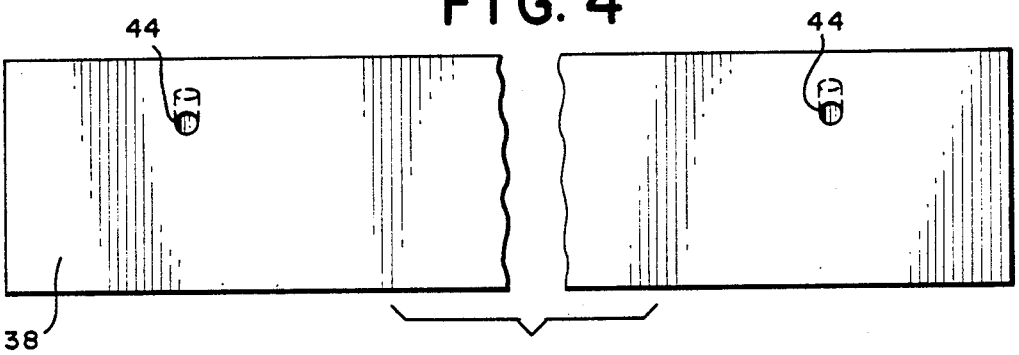
FIG. 5
FIG. 7
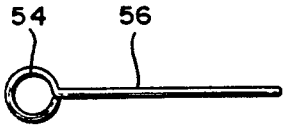
FIG. 8
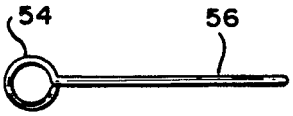
FIG. 9
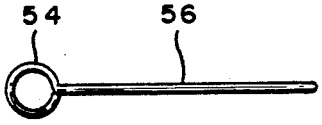
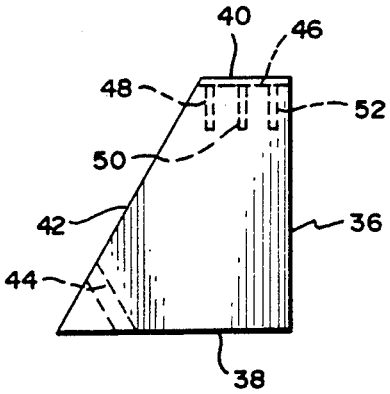
FIG. 6
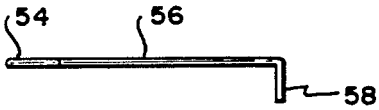
FIG. 10

GOLF PUTTING PRACTICE DEVICE

FIELD OF THE INVENTION

The present invention is directed generally to a golf putting practice device. More particularly, the present invention is directed to a golf putting stroke practice device. Most specifically, the present invention is directed to a golf putting stroke practice device having an elongated base and a sight. The base is placed on a putting surface and provides an elongated guide for the toe of the putter. A sight is used to align the sweet-spot of the putter with a marker placed on the putting surface. A golf ball may then be placed atop the marker and putted in a normal manner. The golfer can then ascertain whether or not he has held his head and body still during the putt by checking to see if the marker is still visible through the sight after he has completed his putt.

DESCRIPTION OF THE PRIOR ART

Golf is one of the most popular recreational activities presently enjoyed. The number of people playing golf continues to increase as does the number of golf courses. However, for all of its popularity, golf is also a game that is not easily mastered and which can become a great source of frustration to the player who would like to play the game better but whose efforts to do so often do not result in a noticeable lowering of his score.

A casual perusal of any golf pro shop, or golf equipment catalog will show the vast array and wide diversity of golf instructional aids that are available to the golfer. These include instructional manuals, video tapes, books, magazines and even golf schools and seminars. There are also available a number of training aids, such as swing trainers, putting stroke assists, and the like. These devices and instructional aids range from simple to highly complex and from inexpensive to very costly. The effectiveness of the aid is often not a function either of its cost or complexity.

The patent art is likewise replete with patents disclosing golf training aids. Several such patents which show golf putting practice or training aids are the following:

| Patents | Inventors |
|---|---|
| 2,776,836 | A.F. Zadina |
| 3,246,898 | M.M. Shoaf, Jr. |
| 3,332,688 | H. Gevertz |
| 3,375,010 | A.E. Panza |
| 3,656,752 | Moriarty |
| 3,853,325 | Easterbrook |
| 3,857,570 | Gutierrez et al |
| 3,934,874 | Henderson |
| 4,053,160 | Salata |
| 4,116,447 | Becker |
| 4,736,952 | Taft et al |

As with the other available golf aids, the devices described in these patents range from the simple to the complex. These various devices may or may not be effective in improving a player's golf game generally and his ability to consistently make accurate putts.

A pervasive problem with prior art putting stroke practice devices is their complexity. An effective practice or training device should perform its function in an unobtrusive, non-complex manner. If a person using the device must first master the practice device, he is not apt to be able to use the device to improve his putting accuracy. Complexity of prior art training and practice devices also results in a device which may not be durable and which may be easily broken or damaged. In a game where the object is to strike a ball with a club, a delicate or fragile practice aid will quickly be rendered ineffective by repeatedly being inadvertently struck or hit during practice.

A golf putting practice device must be small and portable so that it can be used on a practice green or any other similar area. It must be easily assembled and readily useable. Various ones of the prior devices that have been proposed have not been able to be easily carried to a point of use or quickly assembled. A practice device that requires elaborate set-up, or which is large and bulky, will not be used frequently enough to be of any value. Since repetition is the key to consistent putting, and since repetition is not apt to occur if the practice device is not convenient, simple, durable and effective, various prior art golf putting practice devices have not accomplished the desired result.

It will be apparent that a need exists for an effective and dependable golf putting stroke training device. The golf putting practice device in accordance with the present invention provides such a device and is a significant improvement over the prior art devices.

SUMMARY OF THE INVENTION

It is an object of the present invention to provide a golf practice device.

Another object of the present invention is to provide a golf putting practice device.

A further object of the present invention is to provide a golf putting stroke practice device.

Yet another object of the present invention is to provide a golf putting practice device having a vertical golf putter toe guide surface.

Still a further object of the present invention is to provide a golf putting practice device having an adjustable sight.

Even yet another object of the present invention is to provide a golf putting practice device in which the sight is longitudinally positionable along the length of the toe guide surface.

Still even a further object of the present invention is to provide a golf putting practice device which is simple, durable and effective.

As will be discussed in detail in the description of the preferred embodiment which is set forth hereinafter, the golf putting practice device in accordance with the present invention utilizes a base and a sight. The base includes a generally vertical and longitudinally elongated putter toe guide surface. The sight is a wire with a sight loop at a first end of an elongated arm and a leg at a second end of the arm. The leg of the sight is insertable into a selected one of a plurality of spaced bores on the top of the base. This allows the location of the sight ring or loop to be varied both in distance away from the putter toe guide surface and also along the length of the base.

In use, a golfer assumes his normal stance over the golf putter practice device and brings the toe of his putter into contact with the vertical guide surface. The sight is then positioned so that the sight loop overlies the putter's sweet-spot. A suitable marker is then placed on the putting surface and a golf ball is placed on top of the marker. The golfer then makes his normal putting stroke. If he can still see the marker through the sight loop after he has completed his putt, he knows that he has kept his head steady and has stroked squarely. If the marker is not visible, it indicates a need for more practice.

The golf putting stroke practice device of the present invention is structurally uncomplicated and is easy to use. It thus is truly a practice aid and, as opposed to various prior devices, does not itself require an extensive period of familiarization. A person using this device does not have to first master the practice device before he can derive a benefit from it. The device is easy to use and is not complex.

The base of the golf putting practice device is essentially an elongated member having a plurality of spaced bores which will receive the leg of the sight. When the sight is removed, the base can easily be placed in a golf bag and can be carried from place to place with no possibility of being damaged. Once at a point of use, the base is merely placed on the ground, may be anchored in place using a pair of golf tees, and is ready for use when the sight's leg is placed in a selected bore. There is no complex setup required and the device is virtually unbreakable. The golf putting device can be used repeatedly or intermittently with ease, dependability, and convenience to dramatically improve a golfer's ability to consistently make accurate putts. As such it is a substantial advance in the art.

BRIEF DESCRIPTION OF THE DRAWINGS

While the novel features of the golf putting practice device in accordance with the present invention are set forth with particularly in the appended claims, a full and complete understanding of the invention may be had by referring to the detailed description of the preferred embodiment which is presented subsequently, and as illustrated in the accompanying drawings, in which:

FIG. 1 is a perspective view of the golf putting practice device in accordance with the present invention and showing the device in use;

FIG. 2 is a front elevation view of the base of the golf putting practice device;

FIG. 3 is a rear elevation view of the base;

FIG. 4 is a top plan view of the base;

FIG. 5 is a bottom plan view of the base;

FIG. 6 is an end view of the base;

FIGS. 7, 8, and 9 are top plan views of three sights useable with the base; and FIG. 10 is a side elevation view of the sight of FIG. 9.

DESCRIPTION OF THE PREFERRED EMBODIMENT

Referring initially to FIG. 1, there may be seen a preferred embodiment of a golf putting practice device in accordance with the present invention, generally at 12. Golf putting practice or training device 12 is comprised generally of a base 14 and a sight 16. The golf putting practice device 12 is utilizable by a golfer who uses his golf club 18 to strike or putt a golf ball 20. It will be understood that golf club 18 is representative of any number of golf putters which are useable with golf putting practice device 12. These golf putters 18 have a putter head 22 which is secured to the lower end of a shaft 24. The putter head 22 includes a toe 26, a ball engaging face 28 having a sweet-spot 30, a heel 32, and a putting surface engaging lower edge 34. As is well known by all golf players, an ideal putt is one in which the sweet-spot of the putter face 28 contacts the ball 20 while the direction of travel of the club is one in which the plane of the face 28 is generally perpendicular to the desired direction of travel of the ball 20 after it has been struck in the course of the putt. Deviations from this desired point of contact and direction of stroke will result in inaccurate putts. The golf putting practice device, generally at 12, aids the golfer in becoming more proficient at consistently making accurate, smooth putts.

Again referring to FIG. 1, base 14 of golf putting practice device 12 is generally an elongated element which, as may be seen most clearly in FIG. 6, is somewhat trapezoidal in vertical cross-section. A front face 36 of base 14 is generally planar and is oriented generally vertically when a planar bottom surface 38, seen most clearly in FIG. 5, is placed on a putter surface. Front face 36 is substantially longer than it is high. However, as may be seen in FIG. 1, the height of front face 36, which is the distance between the base bottom surface 38 and a base top surface 40 is sufficient to allow the unrestricted passage of a putter head 22 along front face 36 and beneath sight 16 which, as will be discussed subsequently, is supported by top surface 40 of base 14. It will be understood that the generally vertical, planar elongated front face 36 of base 14 is generally smooth and forms an abutment surface that is engageble by, and provides a guide for the toe 26 of the putter head 22 during a practice putting stroke.

As may be seen most clearly in FIGS. 3, 4 and 6, rear surface 42 of golf putting practice device base 14 is inclined generally upwardly and inwardly from bottom surface 38 to top surface 40. This inclined rear surface 42 is provided with at least two spaced holes 44 which extend from the rear inclined surface 42 through to the bottom surface 38 of the base 14. Each of these holes 44 is angled with respect to the front planar face 36 of base 14, as may be seen most clearly in FIG. 6. These spaced holes 44 provide passages through which suitable base affixing members, such as conventional golf tees (not shown) may pass to secure the base 14 in place on a putting surface. The acute angle formed by the axis of each such hole 44 and the planar front face 36 of the base 14 aids in securing base 14 against displacement when the toe 26 of the putter head 22 contacts, and slides along the elongated front surface 36 of the base. While holes 44 are sized to receive golf tees of conventional size, it will be understood that other elongated fasteners could be placed in holes 44. Additionally, while not specifically depicted, it will be understood that suitable hook and loop or other types of fasteners could be used to secure base 14 to an artificial putting surface or to an indoor carpet.

Top surface 40 of base 14 of the golf putting practice device 12 is provided with a plurality of spaced, generally parallel, grooves 46, as may be seen in FIGS. 1–4 and 6. All of these grooves have an uniform depth, which is essentially the same as, or slightly greater than the diameter of the wire which is used to form the sight 16, as will be discussed shortly. As may be seen most clearly in FIG. 4, each groove 46 is also generally perpendicular to the generally planar front face 36 of the base 14.

Each groove 46 is provided with a plurality of spaced bores with, as may be seen in FIGS. 4 and 6, in the preferred embodiment there being provided a rear bore 48, a central bore 50, and a front bore 52. These three spaced bores 48, 50 and 52 in each groove 46 are generally vertical, are generally perpendicular to their associated groove 46, and are generally parallel to the front face 36 of the base. They serve as receptacles for the sight 16, as will now be discussed.

Turning now to FIGS. 7–10 there may be seen several sights 16 for use with the base 14 to provide the golf putting practice device 12 of the present invention. Each such sight includes a sight ring or loop 54 which is formed at a first end of an elongated sight arm 56. A downwardly directed sight leg 58 is formed at a second end of the elongated sight arm 56. Typically, sight 16 is formed of relatively rigid wire. However other materials, such as resilient or unbreakable plastics or other suitable materials could be used. The diameter or thickness of the sight leg 56 is sized to fit within each bore 48, 50 or 52 in each groove 46. It will be understood that the length of the sight leg 58 is less than the depth of each of the bores 48, 50 and 52 in each groove 46. Thus when the sight leg 58 is inserted into a selected bore 48, 50 or 52 in a desired groove 46, the sight arm 56 will contact the bottom of the groove and will not protrude above the top surface 40 of the base 14.

As may be seen in FIGS. 7, 8, and 9 the sight 16 may be provided having various lengths of arms 56. As may be seen in FIG. 1, the sight arm 56 protects in a cantilever manner from base 14 so that the sight ring 54 is located in a vertical plane that will intersect the sweet spot 30 of a putter face 28 when the golf putter practice device 12 is in use. By providing multiple bores 48, 50, and 52 in each groove 46, and by providing several sight arm lengths, the sight ring 54 can be properly located for virtually any putter. Since the distance from the putter sweet spot 30 to the putter toe 26 varies widely with different putters, the adjustably provided by the multiple bores 48, 50, and 52 and the various sight arms 56 makes the golf putting practice device 12 of the present invention useable with virtually any putter 18.

In use, a golfer places base 14 on a putting surface which typically will be an outside putting green, and secures base 14 in place by inserting golf tees or other suitable elongated elements through holes 44. If the golfer is practicing putting into a golf ball receiving cup, he will align the front face 36 of the base with the desired direction of travel of the putt. The golfer assumes his normal putting stance and while grasping the shaft 24 of his putter 18, moves the toe 26 of putter 18 into abutment with the face 36 of the base 14. He then places a suitable marker on the putting surface in front of the sweet spot 30 of the club head 22. He then selects a sight 16 having an arm 56 of suitable length which, in concert with the various bores 48, 50, and 52 in each groove 46, will allow him to place the sight loop or ring 54 in vertical alignment with the previously placed marker. Once this has been done, the golfer may place a golf ball 20 on top of the marker. Using the front face 36 of the base 14 as a guide for the toe 26 of the putter 22, the golfer then strokes a putt while observing the ball 20 through the sight loop 54 along a line of sight 60. After the putt has been made, if the golfer can see the marker through the sight loop 54, he knows that he has held his head steady and has stroked squarely. If he cannot see the marker, he knows that additional practice is necessary.

The provision of a plurality of grooves 46 along the top surface 40 of the base 14 allows the golfer to place the sight 16 along the length of the base 14 in accordance with the portion of his putting stroke that needs guidance. If the putter is apt to have a problem with the initiation of his putting stroke, he may place the sight 16 at the end 62 of the base 14 closest to the golf hole. This provides more length of the front face 36 to guide the toe 26 of the putter 22 prior to striking the ball 20. Alternatively, if the problem is an erratic follow-through, the sight 16 can be placed closer to the rear end 64 of the base 14 remote from the golf hole or similar target. This placement will stabilize and guide the toe 26 of the putter 22 after the ball 20 has been hit. A placement of the sight 16 is a groove 46 generally midway between the ends of the base will provide guidance for the putter 22 both before and after contact with the ball 20.

The base 14 may be made of any durable, long-lasting material. Wood, plastic and the like are suitable materials. The base 14 may easily be placed in a golf bag and is easily set up for use. Once a proper length sight 16 has been selected and positioned in an appropriate bore 48, 50, or 52, in accordance with the size of the putter being used, a plurality of practice putts may be made quickly, repetitively and effectively. Thus it will be apparent that the golf putting practice device 12 of the present invention provides an effective golf practice aid.

While a preferred embodiment of a golf putting practice device in accordance with the present invention has been set forth fully and completely hereinabove, it will be apparent to one of skill in the art that number of changes in, for example the materials used for the base and sight, the specific number of anchoring holes and sight grooves and the like could be made without departing from the true spirit and scope of the invention which is to be limited only by the following claims.

What is claimed is

1. A golf putting practice device comprising:

a base having an elongated, generally vertical, planar putter guide surface;

at least a first groove formed in an upper face of said base and extending generally perpendicular to said putter guide surface; and a sight adjustably positionable in said groove and having a sight loop formed at a first end of a sight arm, said sight arm extending outwardly from said base in a cantilever manner to position said sight loop above a sweet spot of a golf club when a toe portion of a golf club is in abutting engagement with said planar putter guide surface of said base of said golf putting practice device.

2. The golf putting practice device of claim 1 further including means to secure said base to a putting surface.

3. The golf putting practice device of claim 2 wherein said means to secure said base to a putting surface includes spaced holes in said base, said holes being adapted to receive elongated putting surface engaging members.

4. The golf putting practice device of claim 1 wherein said planar putter guide surface is greater in length than in height and further wherein said height is sufficient to allow a putter head to pass unrestrictedly beneath said sight arm.

5. The golf putting practice device of claim 1 wherein said at least first groove has a plurality of spaced downwardly extending bores formed therein.

6. The golf putting practice device of claim 5 wherein said sight further includes a downwardly extending leg, said sight leg being adapted to fit into a selected one of said spaced bores in said groove.

7. The golf putting practice device of claim further including a plurality of generally parallel spaced grooves formed in said upper face of said base.

8. The golf putting practice device of claim 7 wherein each of said spaced grooves has a plurality of spaced downwardly extending bores formed therein.

9. The golf putting practice device of claim 8 wherein said sight further includes a downwardly extending leg said leg being adapted to fit in any selected one of said spaced bores in any one of said spaced grooves.

10. A golf putting practice device comprising:

an elongated base having a putting surface engaging bottom, and a generally vertical planar putter guide surface;

means to removable secure said base to a putting surface;

a plurality of generally parallel spaced grooves formed in an upper face of said base, each of said grooves extending generally transverse to said putter guide surface;

a plurality of spaced, downwardly extending bores in each of said grooves; and a sight having a sight loop at a first end of a sight arm and having a downwardly extending leg at a second end of said sight arm, said leg being adapted to fit into any selected one of said spaced bores in any one of said spaced grooves, said sight arm being of sufficient length to position said sight loop in a cantilever manner above and away from said putter guide surface.

* * * * *